United States Patent [19]

Bobbe et al.

[11] 4,227,795

[45] Oct. 14, 1980

[54] HALF-TONE IMAGING SYSTEM

[75] Inventors: Richard M. Bobbe, Rochester; John A. Durbin, Webster; Richard F. Lehman, Fairport; Frederick A. Seedhouse, Webster, all of N.Y.

[73] Assignee: Xerox Corporation, Stamford, Conn.

[21] Appl. No.: 758,736

[22] Filed: Jan. 12, 1977

[51] Int. Cl.[3] ..... G03G 15/00

[52] U.S. Cl. ..... 355/3 R; 355/4; 355/71

[58] Field of Search ..... 355/3 R, 4, 8, 69, 71

[56] References Cited

U.S. PATENT DOCUMENTS

| | | | |
|---|---|---|---|
| 3,763,758 | 10/1973 | Manack et al. | 354/298 |
| 3,936,173 | 2/1976 | Kidd et al. | 355/4 X |
| 3,967,893 | 7/1976 | Majewicz | 355/69 X |
| 4,007,981 | 2/1977 | Goren | 355/4 |
| 4,012,137 | 3/1977 | Goren | 355/4 |

*Primary Examiner*—Fred L. Braun

*Attorney, Agent, or Firm*—H. Fleischer; J. J. Ralabate; C. A. Green

[57] ABSTRACT

An optical system in which a movable photosensitive member is exposed to a light image of an original document. The optical system includes a light source which illuminates a screen having at least two adjacent spaced rows of opaque dots. Movement of the photosensitive member controls activation of the light source. The light source is activated periodically and responds to the photosensitive member moving a distance corresponding to the distance between adjacent rows of opaque dots on the screen.

9 Claims, 4 Drawing Figures

HALF-TONE IMAGING SYSTEM

BACKGROUND OF THE INVENTION

The present invention relates generally to an electrophotographic printing machine, and more particularly concerns an optical system utilizing a half-tone screen.

In the process of electrophotographic printing, an electrostatic latent image is recorded on a photoconductive member and developed with toner particles. Generally, a sheet of support material is brought into contact with the toner powder image and the particles are transferred thereto, in image configuration. Thereafter, the toner particles are permanently affixed to the sheet of support material to form a copy of the original document. The photoconductive member is initially sensitized by charging the surface thereof substantially uniformly. After the photoconductive member is charged, a light image of the original document is projected thereon. This light image selectively dissipates the charge on the photoconductive member to record an electrostatic latent image thereon.

Multi-color electrophotographic printing is similar to black and white printing. In multi-color printing, the process is repeated a plurality of cycles, each cycle being for discrete color contained in the original document. The light image is filtered to record an electrostatic latent image on the photoconductive member corresponding to a single color. A plurality of different single color light images are formed. Each single color electrostatic latent image is developed with toner particles complementary in color to the color of the filtered light image. These toner particles are then transferred to the sheet of support material in superimposed registration with one another to form a multi-color copy corresponding to the original document. Thereafter, the multi-layered toner powder image is permanently affixed to the sheet of support material by the application of heat thereto.

An electrophotographic printing machine may reproduce a functional or pictorial document. Functional documents visually do not have subtle variations of tone or color. Such documents typically contain line information and are typed sheets, graphs, charts, lines, etc. A pictorial document may be reproduced obtained by utilizing a half-tone screen. The screen produces tone graduations by forming half-tone dots or lines of varying size. In the highlight regions, the half-tone pattern may comprise narrow lines or small dots. The lines or dots increase in width and size throughout the intermediate shades until they merge together at the shadow end. Thus, there will generally be complete whiteness at the high light end and nearly solid blackness at the shadow end of the tonal scale.

The process of screening may be carried out generally in either of two ways. One approach, generally termed multiplicative in the art, is to transmit the light image of the original document directly through the screen to expose the charged photoconductive member therewith. The screen modulates or finely divides the light image to form a half-tone image. A second approach forms a light image of a screen pattern and irradiates the charged photoconductive surface therewith. Prior to or subsequent to the formation of the screen light image, a light image of the original document is projected onto the charged portion of the photoconductive member. The light image of the original document and the screen light image are superimposed on the photoconductive member. Thus, the resultant electrostatic latent image is finely divided by the screen pattern. In sequential screening, as this latter approach is termed in the art, the screen and light source associated therewith are disposed prior to or subsequent to the projection of the light image of the original document onto the photoconductive member. In multi-color electrophotographic printing, the problem of Morie' patterns must be overcome. Frequently, this is achieved by rotating the screen between successive single color light images to minimize this effect.

Many patents exemplify the art of screening. U.S. Pat. Nos. 2,598,732; 3,535,036; 3,121,010; 3,493,381; 3,776,633; and 3,809,555 all teach various screening techniques. Of particular note are U.S. Pat. Nos. 3,535,036 and 3,540,806, both having been issued to Starkweather in 1970. The Starkweather patents disclose the use of timed light flashes through a light baffle having a screen onto a photoreceptor surface to form a half-tone light pattern thereon. The screen may be located before or after the exposure station. U.S. Patent application Ser. No. 701,445 filed June 30, 1976, now abandoned, discloses a screening system wherein a light source illuminating the screen is flashed sequentially as a function of the photoconductive position. This signal actuates a lamp illuminating the screen member periodically. In this manner, the effect of speed errors in the movement of the photoconductive surface are minimized. However, none of the foregoing approaches appear to correct for Morie' effects as well as speed variations.

Accordingly, it is a primary object of the present invention to improve the screening system employed in electrophotographic printing machines by controlling screen illumination as a function of the movement of the photoconductive member with respect to the spacing between adjacent rows of dots on the screen.

SUMMARY OF THE INVENTION

Briefly stated, and in accordance with the present invention, there is provided an optical system for exposing a moveable photosensitive member to a light image of an original document.

Pursuant to the features of the present invention, means are provided for sensing the movement of the photosensitive member and generating a signal indicative thereof. A screen member is disposed closely adjacent to the photosensitive member. The screen member has at least two adjacent spaced rows of opaque dots. A light source is positioned to transmit light rays through the screen member onto the photosensitive member. In this manner, a finely divided charge pattern is recorded on the photosensitive member. The light source is actuated in response to the signal from the sensing means indicating that photosensitive member moved a distance substantially equal to the distance between adjacent rows of dots on the screen member.

BRIEF DESCRIPTION OF THE DRAWINGS

Other objects and advantages of the present invention will become apparent from reading the following detailed description and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
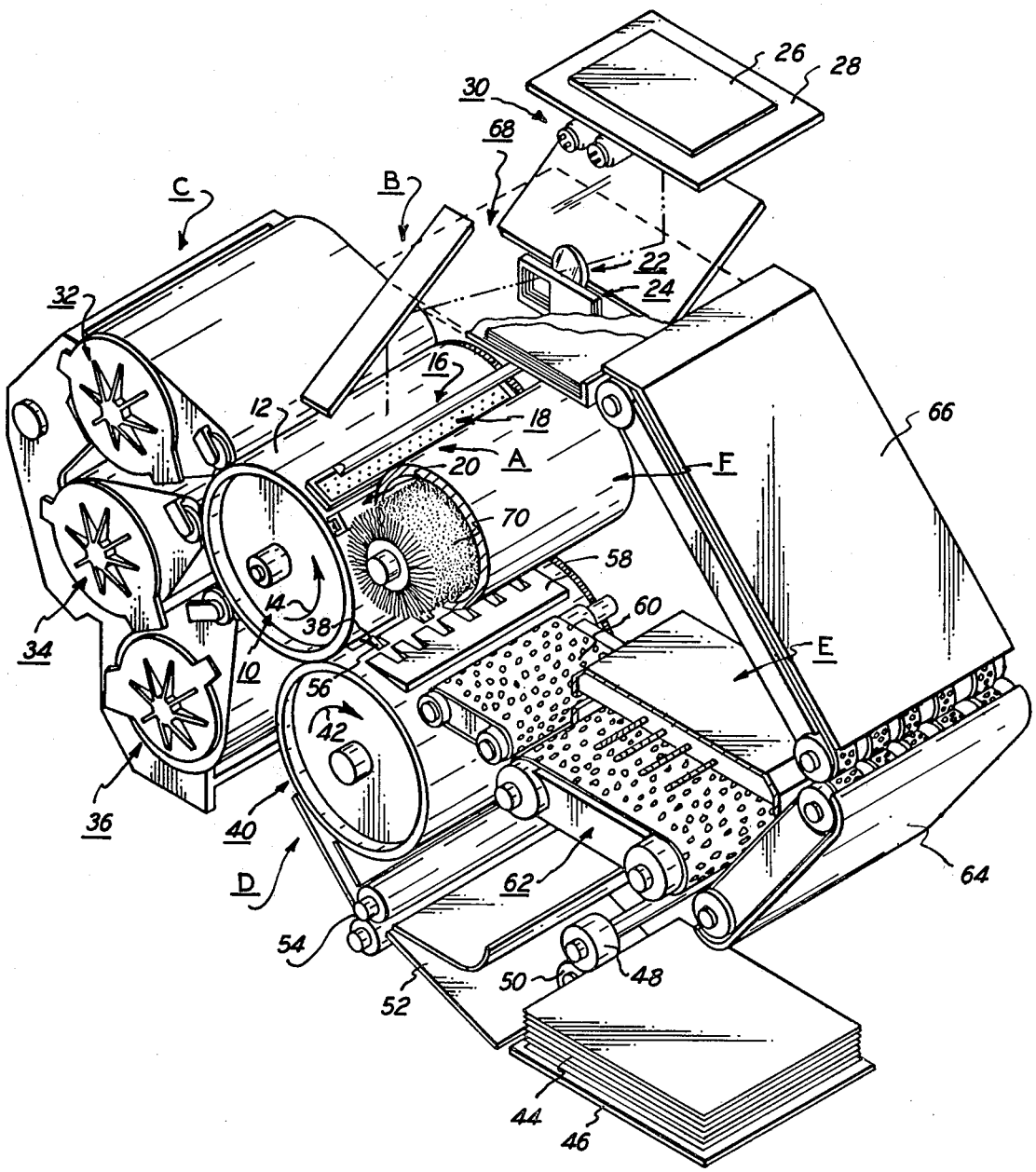
FIG. 1 is a schematic, perspective view of an electrophotographic printing machine incorporating the features of the present invention therein.

A general understanding of an electrophotographic printing machine incorporating the features of the present invention therein, may be had by referring to FIG. 1. In all of the drawings, like reference numerals have been used throughout to designate identical elements. The electrophotographic printing machine shown in FIG. 1 is arranged to produce copies from a colored pictorial original document. The original document may be in the form of single sheets, books, three dimensional objects, color slides, etc.

As illustrated in FIG. 1, the electrophotographic printing machine comprises a photoconductive member having a rotatable drum 10 with a photoconductive surface 12 secured thereto and entrained thereabout. Drum 10 is mounted on a shaft 90 (FIG. 4) and rotated in the direction of arrow 14. In this way, a portion of photoconductive surface 12 is moved sequentially through a series of processing stations. Preferably, photoconductive surface 12 is made from a suitable selenium alloy such as described in U.S. Pat. No. 3,655,377 issued to Sechak in 1972. An opaque disc 88 (FIG. 4) is mounted on one end of shaft 90 (FIG. 4) of drum 10. This disc cooperates with a light source 94 (FIG. 4) and photosensor 96 (FIG. 4) to produce an electrical signal which is coupled to the control logic regulating the periodic actuation of light source 16 illuminating screen 18. In this way, after drum 10 rotates through a distance corresponding to the distance between adjacent rows of dots on screen 18, light source 16 is actuated to illuminate screen 18.

For purposes of the present disclosure, the various processing stations in the printing machine will be briefly described hereinafter.

As drum 10 rotates in the direction of arrow 14, it passes through charging station A. Charging station A includes a corona generating device, indicated generally by the reference numeral 20. Corona generating device 20 charges photoconductive surface 12 to a relatively high substantially uniform level. Preferably, corona generating device 20 extends in a generally transverse direction across photoconductive surface 12 to produce a spray of ions for the charging thereof. One type of suitable corona generating device is described in U.S. Pat. No. 3,942,006 issued to Hayne in 1976.

After a portion of photoconductive surface 12 is charged to a substantially uniform level, drum 10 rotates the charged portion thereof to exposure station B. At exposure station B, the charged portion of photoconductive surface 12 is exposed to a color filtered light image of the original document. A moving lens system, generally designated by the reference numeral 22, and a color filter mechanism, shown generally at 24, are positioned at exposure station B. U.S. Pat. No. 3,062,108 issued to Mayo in 1952 describes a moving lens system suitable for use in electrophotographic printing. A color filter mechanism suitable for use in the FIG. 1 electrophotographic printing machine is described in U.S. Pat. No. 3,775,006 issued to Hartman et al in 1973. Original document 26 is disposed upon transparent viewing platen 28. Lamp assembly 30, lens system 22 and filter mechanism 24, move in a timed relationship with drum 10 to scan successive incremental areas of original document 26. A suitable type of lens is described in U.S. Pat. No. 3,592,531 issued to McCrobie in 1971. In this manner, a flowing light image of original document 26 is produced. The light image corresponds to a single color of the informational areas contained within original document 26. Screen 18 is positioned prior to, or, alternatively, subsequent to the optical light path. Lamp 16 is actuated periodically to illuminate screen 18 which transmits a screen light image onto the charged portion of photoconductive surface 12 to record a finely divided charge pattern thereon. Thereafter, the light image of the original document is superimposed over the screen pattern to record a half-tone electrostatic latent image on photoconductive surface 12. The details of the optical system will be described hereinafter with reference to FIG. 2, and the detailed construction of the screen described with reference to FIG. 3. The operation of the entire system will be discussed, in greater detail, with reference to FIG. 4.

After the half-tone electrostatic latent image is recorded on photoconductive surface 12, drum 10 rotates to development station C. At development station C, three developer units, generally indicated by the reference numerals 32, 34 and 36, sequentially develop electrostatic latent images recorded on photoconductive surface 12. A suitable development station having a plurality of developer units (in this case three) is described in U.S. Pat. No. 3,854,449 issued to Davidson in 1974. The developer units described therein are all of a type generally referred to in the art as magnetic brush developer units. Typically, a magnetic brush developer unit employs a magnetizable developer mix comprising carrier granules and toner particles. The developer unit forms a directional flux field to continually create a brush of developer mix. This developer mix brush is brought into contact with the half-tone electrostatic latent image recorded on the photoconductive surface 12. The toner particles adhering triboelectrically to the carrier granules of the developer mix are attracted by the greater electrostatic force to the latent image. In this manner, the latent image is rendered visible. Developer units 32, 34, and 36, respectively, contain discretely colored toner particles. Each of the toner particles contained within the respective developer unit corresponds to the complement of the single color light image transmitted through the differently colored filters. For example, a single color electrostatic latent image formed from a green filtered light image is developed with green absorbing magenta toner particles. Similarly, electrostatic latent images formed from blue and red light images are developed with yellow and cyan toner particles, respectively.

After the electrostatic latent image recorded on photoconductive surface 12 is developed, drum 10 rotates to transfer station D. At transfer station D, the toner powder image adhering electrostatically to photoconductive surface 12 is transferred to a copy sheet or sheet of support material 38. An electrically biased transfer roll, shown generally at 40, recirculates support material 38. Transfer roll 40 is biased electrically to a sufficient magnitude and polarity to electrostatically attract toner particles from photoconductive surface 12 to the sheet of support material secured releasably thereon. In this manner, transfer roll 40, which rotates in the direction of arrow 42, has substantially the same tangential velocity as drum 10 and attracts a plurality of toner powder images to the sheet of support material 38. A suitable electrically biased transfer roll described in U.S. Pat. No. 3,612,677 issued to Langdon et al in 1971.

Briefly describing the sheet feeding path, support material 38 is advanced from stack 44 disposed upon tray 46. Feed roll 48, in operative communication with retard roll 50, separates and advances the uppermost sheet from stack 44. The advancing sheet moves into chute 52 and is directed into the nip between register rolls 54. Register rolls 54 align and forward the advancing sheet, in synchronism with the movement of transfer roll 40. Gripper fingers 56 receive advancing sheet 38 and secure it releasably on transfer roll 40. After the requisite number of toner powder images have been transferred to sheet 38, in superimposed registration with one another, gripper fingers 56 space sheet 38 from transfer roll 40. As transfer roll 40 continues to rotate in the direction of arrow 42, stripper bar 58 is interposed therebetween separating sheet 38 from transfer roll 40. Sheet 38 passes over stripper bar 58 onto conveyor belt 60. Endless belt conveyor 60 moves support material 38 to fixing station E.

At fixing station E, a fuser indicated generally by the reference numeral 62, permanently affixes the transferred toner powder images to support material 38. One type of suitable fuser is described in U.S. Pat. Re. No. 28,802 issued to Draugelis et al in 1976. After the fixing process, sheet 38 is advanced by endless belt conveyors 64 and 66 to catch tray 68 for subsequent removal therefrom by the machine operator.

Generally, following the transfer process, residual toner particles remain adhering to photoconductive surface 12. Cleaning station F, the final processing station in the direction of rotation of drum 10, as indicated by arrow 14, removes these residual toner particles. A pre-clean corona generating device (not shown) neutralizes the charge on photoconductive surface 12 and that of the residual toner particles. This permits fibrous brush 70, in contact with is described in U.S. Pat. No. 3,590,412 issued to Gerbasi in 1971.

It is believed that the foregoing description is sufficient for purposes of the present application to describe an electrophotographic printing machine having the features of the present invention incorporated therein.

Figure 2:
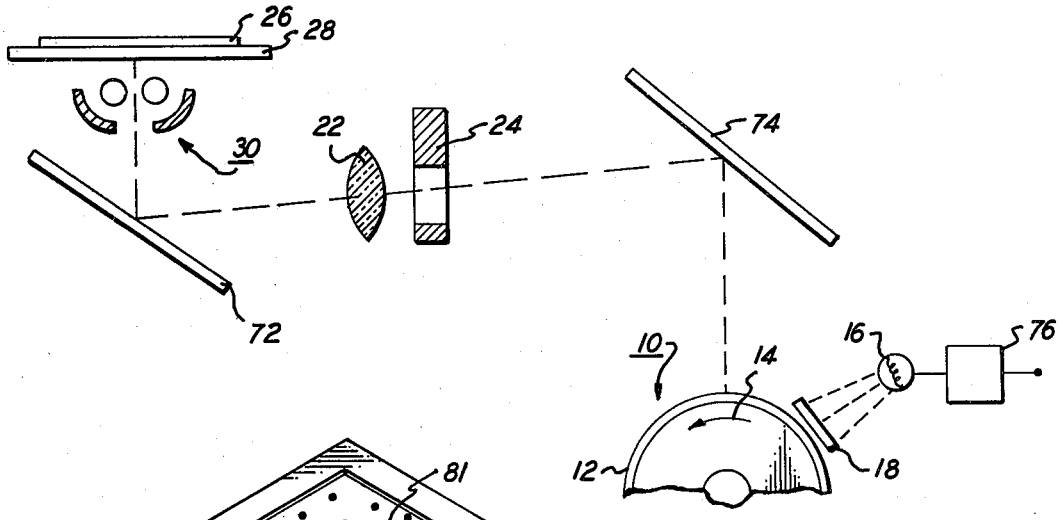
FIG. 2 is an elevational view illustrating the optical system employed in the FIG. 1 printing machine.

Referring now to FIG. 2, there is shown the detailed structure of exposure station B. As depicted thereat, lamps 30 move across platen 28 with original document 26 disposed face down thereon. The light rays reflected from original document 26 pass through transparent platen 28 onto mirror 72. Mirror 72 reflects the light rays through lens 22 which forms the flowing light image thereof. The flowing light image is then transmitted through the selected filter of filter mechanism 24 to produce a single color flowing light image. The single color flowing light image is reflected by mirror 74 onto the charged portion of photoconductive surface 12. As illustrated in FIG. 2, a screen member 18 is positioned at exposure station B prior to the path of the light image. It is to be noted that screen member 18 may be located either prior to or subsequent to the light image optical path. The flowing light image irradiates the portion of photoconductive surface 12 having the screen pattern recorded thereon. In the event that screen 18 is located after the formation of the flowing light image, the screen light pattern will be superimposed onto the latent image of the original document recorded on photoconductive surface 12. The screen pattern is formed by screen member 18 having light rays from light source or lamp 16 passing therethrough and irradiating photoconductive surface 12 prior to or subsequent to the formation of the latent image of the original document. High voltage power supply 76 periodically ignites light source 16. Preferably, screen member 18 is a transparent sheet having a plurality of spaced opaque dots thereon. The detailed structure thereof will be discussed hereinafter with reference to FIG. 3. Voltage source 76 is controlled to actuate lamp 16 after drum 10 has rotated a preselected angular distance corresponding to the distance between adjacent rows of dots on screen 18. In this way, successive rows of dots are projected onto the charged portion of photoconductive surface 12 with overlap occurring between successive projections. Moreover, the distance between each projection is substantially equal. Thus, any changes in angular velocity of drum 10 are corrected and Morie' patterns minimized. The screen pattern moves in the direction of arrow 14 and the flowing light image of the original document is projected thereon in superimposed registration therewith. This results in a half-tone electrostatic latent image being recorded on the photoconductive surface 12.

Figure 3:
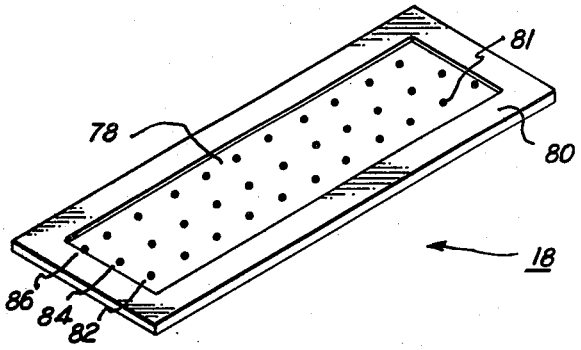
FIG. 3 is an elevational view showing the screen employed in the FIG. 2 optical system.

Turning now to FIG. 3, there is shown the detailed structure of screen member 18. As depicted thereat, a member 78 is disposed in an opaque frame or slit 80. Member 78 has a plurality of dots 81 disposed thereon. The dots are arranged in successive rows 82, 84 and 86. At least three rows of dots are disposed on member 78. Each opaque dot 81 is spaced an equal distance from an adjacent dot in the same row thereof. The dots in row 84 are rotated an angle of about 90° relative to the dots in row 82. The dots in row 86 are also rotated an angle of about 45° relative to the dots in row 84. Light source 16 is actuated periodically. It is actuated when drum 10 has rotated a distance corresponding to the distance between two adjacent rows of dots, i.e. the distance between rows 82 and 84 or rows 84 and 86. Thus, each time drum 10 rotates a distance equal to the distance between adjacent rows of dots, lamp 16 is actuated and a screen pattern corresponding to three rows of dots is projected onto the charged portion of photoconductive surface 12. This produces an overlap of two rows of dots for each illumination cycle. This minimizes the effect of Morie' patterns. Preferably, member 78 is formed from a transparent material with dots 82 disposed thereon caused by either the presence of localized opaque material, or the absence of material. The overall pattern being formed by chemical etching or other suitable techniques. Alternatively, member 78 may be opaque with the dots formed thereon being transparent.

Figure 4:
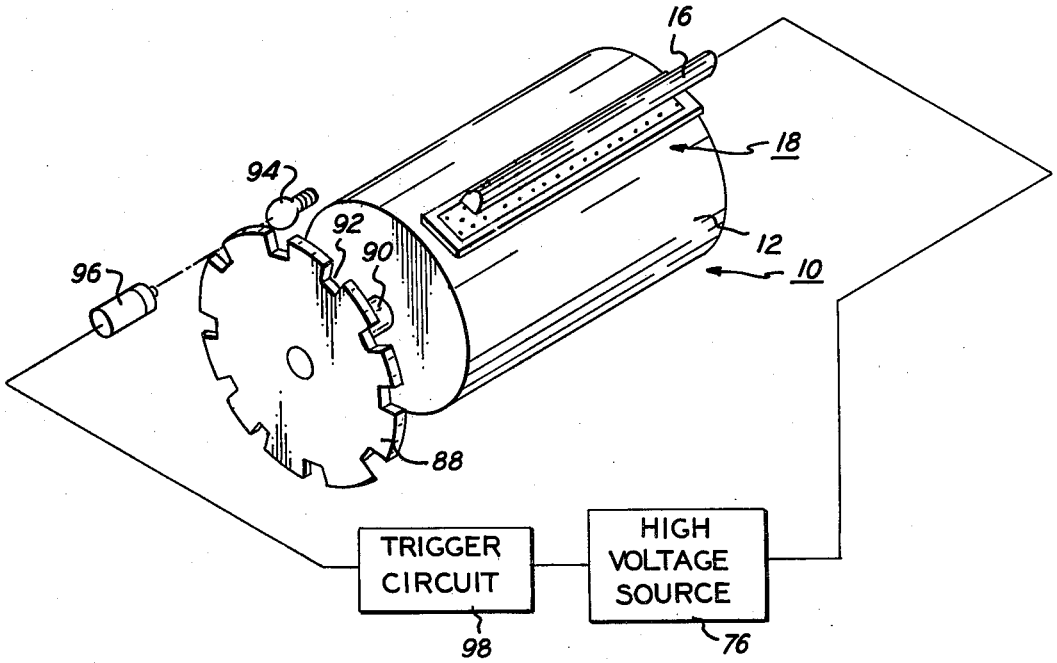
FIG. 4 is a schematic view, partially in perspective, depicting the control system for periodically actuating the lamp illuminating the FIG. 3 screen.

Referring now to FIG. 4, the control system for igniting lamp 16 is described hereinafter. As shown, opaque disc 88 is disposed on shaft 90 of drum 10 and rotates in conjunction therewith. Opaque disc 88 has a plurality of slits 92 in the periphery thereof. Each slit is positioned at about an equal angular distance about the periphery of disc 88. The distance between mutually adjacent slits 92 is less than the distance between mutually adjacent rows of dots on screen member 16. Thus, a discrete number of slits 92 corresponds to the distance between adjacent rows of dots. Hence, after opaque member 88 is rotated a distance corresponding to the distance between adjacent rows of opaque dots on screen 18, light source 16 is actuated by the control system disclosed in FIG. 4. As shown in FIG. 4, light source 94 is disposed on one side of disc 88 and photosensor 96 is located on the other side thereof. As opaque disc 88 rotates, slits 92 pass between light source 94 and photosensor 96. At this time, the light rays from light source 94, e.g. a tungsten lamp, are received by photosensor 96, e.g. a photodarlington. Photosensor 96, in turn, develops an electrical output signal. At any other time, i.e. when the opaque portion of disc 88 is interposed between light source 94 and photosensor 96, no electrical output is developed by photosensor 96. Thus, only when a slit 92 is interposed between photosensor 96 and light source 94, is an electrical output signal developed. This occurs at predetermined distances about the periphery of opaque disc 88 which, in turn, corresponds to a preselected movement of drum 10. In this manner, photosensor 96 is actuated only after drum 10 has rotated through a prescribed angle. The electrical output signal from photosensor 96 is processed by trigger circuit 98. Trigger circuit 98, in turn, actuates voltage source 76 which energizes lamp 16. Hence, lamp 16 is periodically actuated, i.e. only when slit or multiples of slits 92 are interposed between lamp 94 and photosensor 96. Thus, lamp 16 is actuated only when drum 10 has rotated through a predetermined distance corresponding to the distance between adjacent rows of opaque dots on screen 18. Actuation of lamp 16 illuminates screen member 18. As previously noted, screen member 18 comprises a plate 78 having a plurality of spaced dots 81 thereon. The periodic actuation of lamp 16 projects successive rows of dots onto photoconductive surface 12 of drum 10. The dot pattern recorded on photoconductive surface 12 comprises a plurality of equally spaced dots. This forms a finely divided charge pattern on photoconductive surface 12.

In recapitulation, it is evident that the electrophotographic printing machine heretofore described employs an optical system having a sequential screening apparatus wherein the light source illuminating the screen member is actuated periodically. Actuation of the light source occurs when the photoconductive surface moves a distance substantially equal to the distance between adjacent rows of dots disposed on the screen. This is achieved irrespective of any changes in angular velocity of the photoconductive drum inasmuch as the photoconductive drum angular position is being continually monitored. Moreover, the angular orientation between successive rows of dots is varied so as to minimize Morie' patterns.

It is, therefore, apparent that there has been provided in accordance with the present invention, an electrophotographic printing machine that fully satisfies the objects, aims and advantages hereinbefore set forth. While the present invention has been described in conjunction with a specific embodiment thereof, it is evident that many alternatives, modifications and variations will be apparent to those skilled in the art in light of the foregoing description. Accordingly, it is intended to embrace all such alternatives, modifications and equivalents as fall within the spirit and broad scope of the appended claims.

What is claimed is:

1. An optical system for exposing a movable photosensitive member to a light image of an original document, wherein the improvement includes:

means for sensing the position of the photosensitive member and generating a signal indicative thereof;

a screen member disposed closely adjacent to the photosensitive member, said screen member comprising a member; a first row of dots disposed on said member; a second row of dots disposed on said member, said second row of dots being spaced from said first row of dots with each dot of said second row of dots being rotated 90° relative to each row of said first row of dots, and a third row of dots disposed on said member, said third row of dots being spaced from said second row of dots with each dot of said third row of dots being rotated 45° relative to each dot of said second row of dots;

a screen light source positioned to transmit light rays through said screen member onto the photosensitive member to record thereon a finely divided charge pattern; and means, responsive to the signal from said sensing means indicating that the photosensitive member moved a distance substantially equal to the distance between two adjacent rows of dots on said screen member, for actuating said screen light source.

2. An optical system as recited in claim 1, further including:

means for illuminating the original document with light rays;

means for forming the light image of the original document from the light rays transmitted therefrom;

means for projecting the light image of the original document onto the photosensitive member to record thereon a latent image of the original document with the latent image and charge pattern being superimposed over one another on the photosensitive member.

3. An optical system as recited in claim 2, wherein said sensing means includes:

a sensor light source generating light rays;

a photosensor developing an electrical signal in response to detecting the light rays from said sensor light source; and an opaque member interposed between said sensor light source and said photosensor, said opaque member having a plurality of slits therein with the distance between adjacent slits corresponding to a predetermined position of the photosensitive member, said opaque member moving in unison with the photosensitive member so that the signal from said photosensor indicates the position of the photosensitive member.

4. An optical system as recited in claim 3 further including means for filtering the light image of the original document to form successive single color light images.

5. An electrophotographic printing machine, including:

a movable photoconductive member;

means for charging at least a portion of said photoconductive member to a substantially uniform level;

means for exposing the charged portion of said photoconductive member to a light image of an original document to record thereon an electrostatic latent image corresponding to the original document;

means for sensing the position of said photoconductive member and generating a signal indicative thereof;

a screen member disposed closely adjacent to said photoconductive member, said screen member comprising a member, a first row of dots disposed on said member, a second row of dots disposed on said member, said second row of dots being spaced from said first row of dots with each dot of said second row of dots being rotated 90° relative to each dot of said first row of dots, and a third row of dots disposed on said member, said third row of dots being spaced from said second row of dots with each dot of said third row of dots being rotated 45° relative to each dot of said second row of dots;

a screen light source positioned to transmit light rays through said screen member onto said photoconductive member to record thereon a finely divided charge pattern; and means, responsive to the signal from said sensing means indicating that the photoconductive member moved a distance substantially equal to the distance between two adjacent rows of dots on said screen member, for actuating said screen light source.

6. A printing machine as recited in claim 5, further including:

means for illuminating the original document with light rays;

means for forming the light image of the original document from the light rays transmitted therefrom; and means for projecting the light image of the original document onto the charged portion of said photoconductive member to record thereon an electrostatic latent image of the original document with the electrostatic latent image and charge pattern being superimposed over one another forming thereon a half-tone electrostatic latent image.

7. A printing machine as recited in claim 6, wherein said sensing means includes;

a sensor light source generating light rays;

a photosensor developing an electrical signal in response to detecting the light rays from said sensor light source; and an opaque member interposed between said sensor light source and said photosensor, said opaque member having a plurality of slits therein with the distance between adjacent slits corresponding to a predetermined position of said photoconductive member, said opaque member moving in unison with said photoconductive member so that the signal from said photosensor indicates the position of said photoconductive member.

8. A printing machine as recited in claim 7, further including means for filtering the light image of the original document to form successive single color light images.

9. A printing machine as recited in claim 7, further including:

means for developing the half-tone latent image recorded on said photoconductive member with toner particles;

means for transferring the toner particles from the half-tone latent image to a sheet of support material; and means for fixing substantially permanently the toner particles to the sheet of support material.

* * * * *